United States Patent [19]

Dixon

[11] 4,231,387

[45] Nov. 4, 1980

[54] BACKFLOW PREVENTING VALVE

[75] Inventor: Robert W. Dixon, Concord, Calif.

[73] Assignee: Chas. M. Bailey Co., Inc., Emeryville, Calif.

[21] Appl. No.: 2,690

[22] Filed: Jan. 11, 1979

[51] Int. Cl.[3] ..... F16K 24/02

[52] U.S. Cl. ..... 137/218; 137/107

[58] Field of Search ..... 137/218, 102, 107; 251/368

[56] References Cited

U.S. PATENT DOCUMENTS

| | | | |
|---|---|---|---|
| 2,646,064 | 7/1953 | Colton | 137/218 |
| 3,173,439 | 3/1965 | Griswold et al. | 137/218 |
| 3,656,711 | 4/1972 | Toelke | 251/368 |
| 3,724,487 | 4/1973 | Hunter | 137/218 |
| 3,837,358 | 9/1974 | Zieg et al. | 137/218 |
| 3,996,962 | 12/1976 | Sutherland | 137/215 |
| 4,159,025 | 6/1979 | Harthun | 137/218 |

FOREIGN PATENT DOCUMENTS

| | | | |
|---|---|---|---|
| 2450465 | 4/1975 | Fed. Rep. of Germany | 137/218 |
| 2729305 | 1/1979 | Fed. Rep. of Germany | 137/218 |

*Primary Examiner*—William R. Cline
*Assistant Examiner*—H. Jay Spiegel
*Attorney, Agent, or Firm*—Lothrop & West

[57] ABSTRACT

A backflow preventing valve has a body with two principal portions made of a glass-fiber reinforced plastic. One portion has an inlet port and an outlet port on a through axis, the ports opening to an inlet chamber and an outlet chamber respectively. An intermediate chamber merges with the inlet chamber at an inlet valve seat and also merges with the outlet chamber at an outlet valve seat, the valve axes and the through axis being coplanar. Inlet and outlet poppet valves are urged toward their respective seats by springs in the intermediate and the outlet chambers. There is a vent chamber open to the atmosphere and having a vent valve seat merging with the intermediate chamber. A poppet vent valve has a stem movable in a guide toward and away from the vent valve seat. The stem is abutted by a diaphragm disposed between an outer diaphragm chamber and an inner diaphragm chamber and is pressed by a diaphragm spring in the inner diaphragm chamber. There is a first passage extending through the two body portions between the inlet chamber and the outer diaphragm chamber and a second passage extending through the two body portions between the intermediate chamber and the inner diaphragm chamber.

1 Claim, 5 Drawing Figures

FIG-1
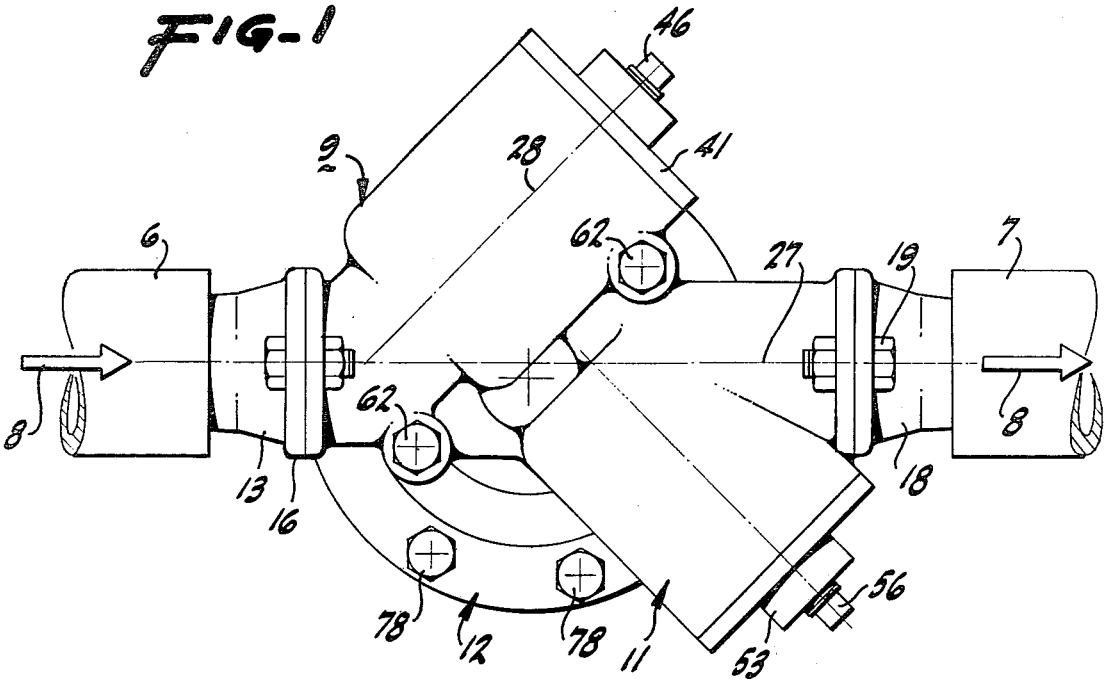
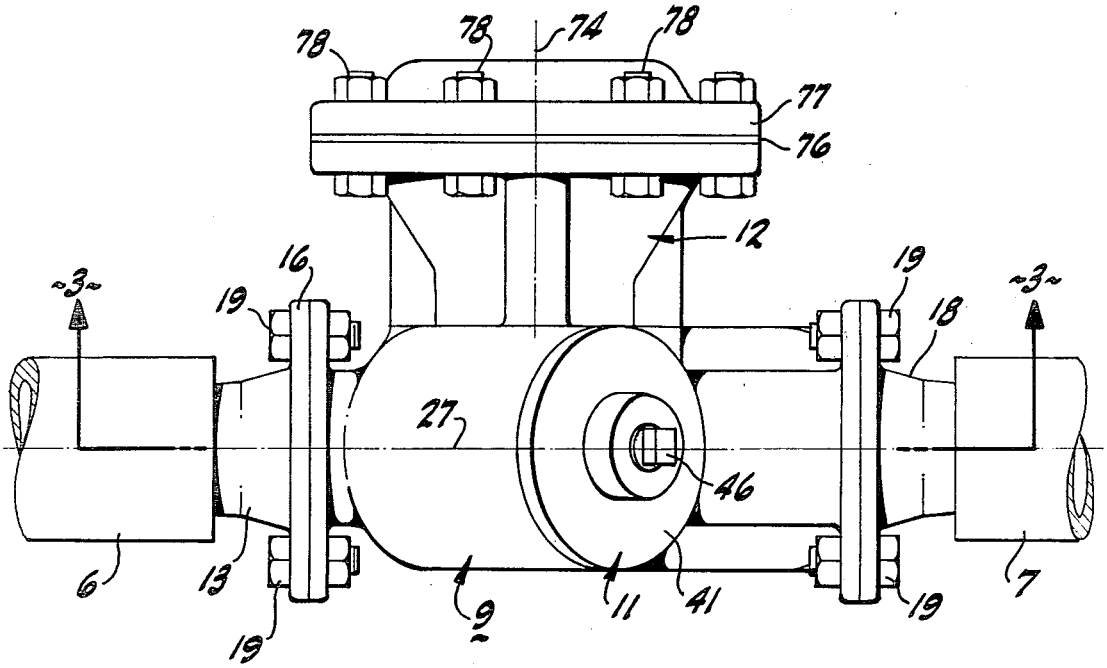
FIG-2

FIG-4
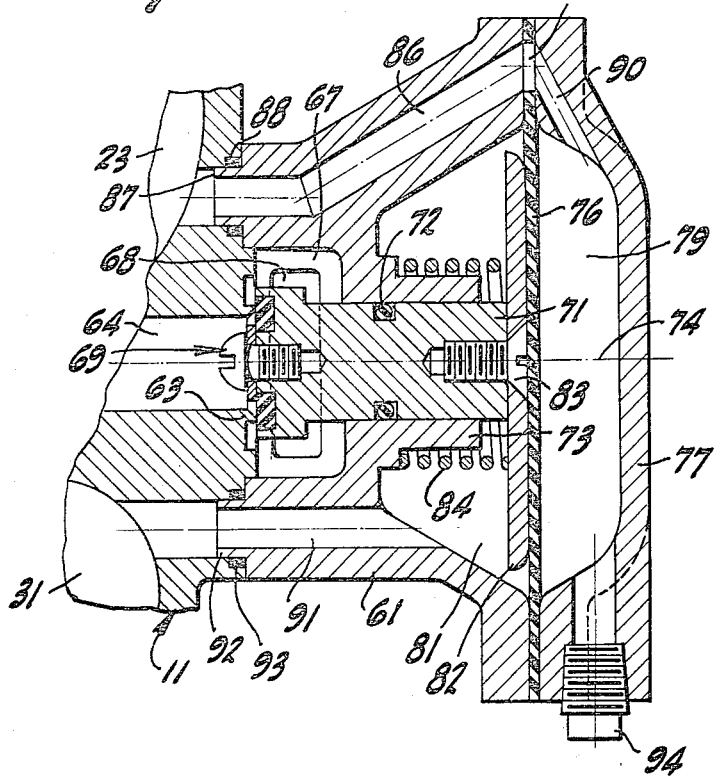
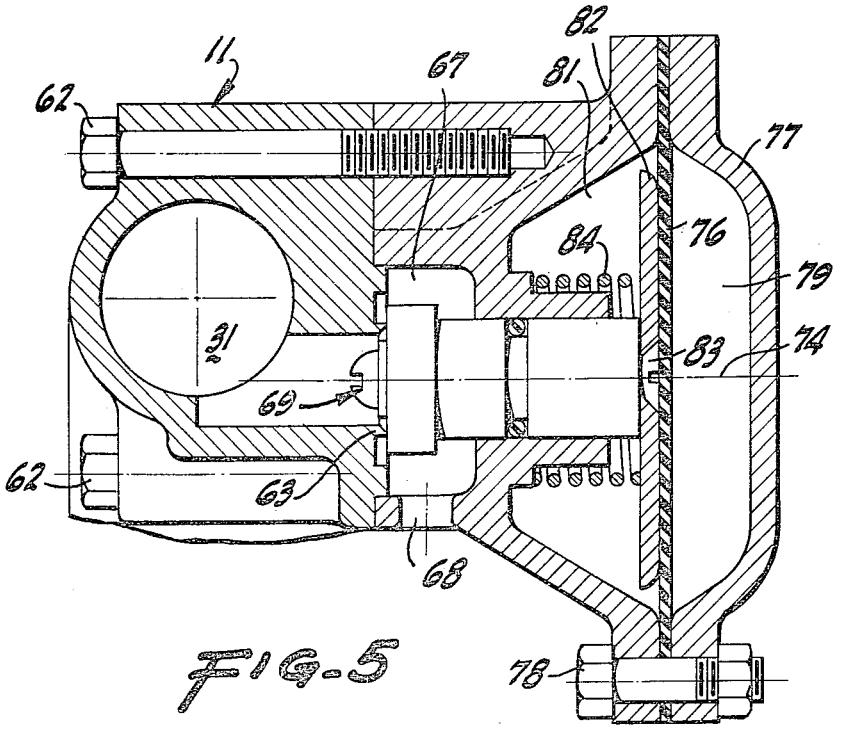
FIG-5

BACKFLOW PREVENTING VALVE

BRIEF SUMMARY OF THE INVENTION

The backflow preventing valve is for use primarily in domestic water circuits and is effective to preclude flow in a counter direction that might cause contamination. The valve includes a two-part body of glass-reinforced plastic having an inlet valve and an outlet valve in their respective chambers connected to an appropriate inlet port and outlet port. There is an intermediate or vent chamber between the two valves, such chamber being open to the atmosphere under control of a vent valve, the motion of which is controlled by a diaphragm arranged between an inner diaphragm chamber and an outer diaphragm chamber. A spring presses on the diaphragm from the inner diaphragm chamber. There is a pressure connection between the inlet chamber and the outer diaphragm chamber, and there is another pressure connection between the intermediate chamber and the inner diaphragm chamber. The vent valve opens to discharge to the atmosphere in the event pressure on the normally downstream side thereof exceeds the pressure on the normally upstream side thereof.

BRIEF DESCRIPTION OF THE SEVERAL VIEWS OF THE DRAWINGS

FIG. 1 is a side elevation of a backflow preventing valve, pursuant to the invention, incorporated in a fluid line.

FIG. 2 is a plan of the valve installation of FIG. 1.

FIG. 4 is a cross-section, the plane of which is indicated by the line 4—4 of FIG. 3.

FIG. 5 is a cross-section, the plane of which is indicated by the line 5—5 of FIG. 3.

DETAILED DESCRIPTION

Figure 3:
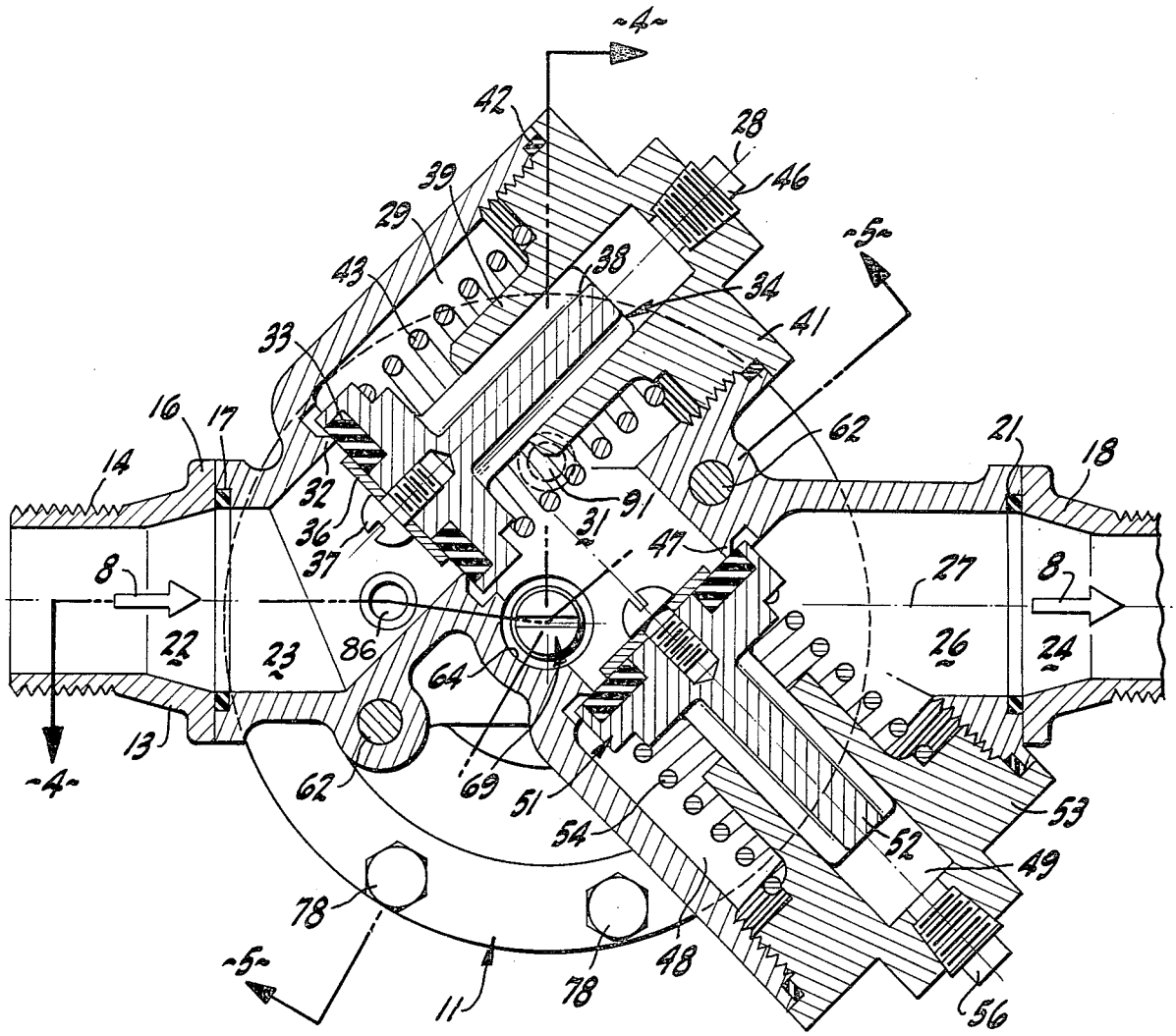
FIG. 3 is a cross-section, the plane of which is indicated by the line 3—3 of FIG. 2.

The backflow preventing valve is preferably for incorporation into a fluid system, especially a hydraulic system including a hydraulic high pressure line 6 or pipe normally discharging into a hydraulic low pressure pipe 7 or line. Flow usually is in the direction of the arrows 8 from the high pressure side to the low pressure side. Under abnormal conditions, the pressure on the side 7 may increase substantially and tend, then, to cause flow from the pipe 7 toward the pipe 6. The material that flows backward from the pipe 7 toward the pipe 6 may be contaminated in some fashion and should not be permitted to enter into the line 6. It is in order to prevent such adverse usage and to discharge any such backflowing material that the present valve is employed. Preferably, the valve comprises a main body 9 made up of two principal portions 11 and 12, both preferably fabricated of a nonmetallic material, especially a fiberglass-reinforced plastic that is substantially inert to the atmosphere and to the liquids with which the valve might be utilized and which is adequately capable of withstanding the ordinary operating pressures.

At the inlet end, the device is provided with a special fitting 13 of similar material having threads 14 for connection to the pipe 6 and having a bolt flange 16 for connection to the remainder of the body, there being an intermediate o-ring17 or seal. Similarly, the discharge end is comparably provided with a threaded fitting 18 held in position by bolts 19 and including an O-ring seal 21. With this arrangement, the fittings 13 and 18 can be positioned on the pipes 6 and 7, and the main body can then be inserted laterally therebetween, and finally the flange bolts can be tightened to afford a leak-proof assembly. In this fashion, the assembly and disassembly of the unit with the pipeline can readily be accomplished. Furthermore, simply by changing the fittings 13 and 18, the particular size of pipe to which the unit is to be fastened can be changed.

Within the principal part 11 of the body there is an inlet port 22 opening into an inlet chamber 23. On the other end of the body there is an outlet port 24 opening from an outlet chamber 26, the ports 22 and 24 being in general transverse alignment on a through axis 27 corresponding generally with the axis of the pipes 6 and 7. The inlet chamber 23 is angled or canted to conform to the axis 28 of a portion 29 of an intermediate chamber 31 occupying the central portion of the body. The intermediate chamber portion 29 merges with the adjacent inlet chamber in an inlet valve seat 32 symmetrical with the axis 28 and shaped as an annular rim.

Designed to be seated on the rim is a valve washer 33 held in place on a poppet valve 34 by a washer 36 and a fastening screw 37. The poppet valve includes a cruciform stem 38 movable along the axis 28 within a guide 39. This is in an intermediate chamber plug 41 having a threaded interengagement with the body portion 11 and being surrounded by an O-ring seal 42 to preclude leakage. A spring 43 surrounds the plug and bears against the valve disc so as to urge the disc against its seat with a predetermined degree of force. In one instance, the spring 43 requires a differential pressure across the valve seat 32 of some five or six pounds to open. There is a removable plug 46 which can readily be replaced by a test cock or test gauge for initial testing and for testing from time to time after the unit has gone into service.

The intermediate chamber 31 merges at an outlet valve seat 47 with a portion 48 of the outlet chamber 26, this portion being symmetrical about an axis 49 extending approximately at right angles to the axis 28 and lying in the same plane as such axis and in the same plane as the through axis 27, so that the parts are compact and afford a short fluid travel distance through the valve. Although there is impact of the flowing fluid and any contained particles against the valve washers, such impact is of an angled or glancing nature when the valves are in open position. The short and reasonably direct flow path through the valve body tends to reduce turbulence and eddies within the device and, with the inclined or angled valves, tends to reduce impact wear and abrasion of the valve washers.

Of the same construction as the primary or inlet valve is an outlet valve 51 having a stem 52 guided in a plug 53 situated in the body portion 11 just as is the plug 41. Substantially the only difference is that a spring 54 surrounding the plug 53 is of somewhat lesser strength than the spring 43, responding to a pressure differential of only about two pounds for a full open motion. There is likewise a pipe plug 56 in the body plug 53 in order for a test cock or gauge to be supplied when desired.

As so far described, liquid flowing normally from the inlet toward the outlet is effective to lift the inlet valve 34 to flow into the intermediate chamber 31, then to lift the outlet valve 51 and so to continue through the outlet chamber26 and into the pipe 7. Conversely, if the pressure drop across the valve body should change its direction, then it would be expected that the outlet valve 51 would close, preventing any flow into the intermediate chamber from the outlet chamber. However, it occasionally happens that under adverse circumstances due to old age or adverse wear conditions or the like the valve 51 cannot be entirely relied upon to seat fully. There is thus some likelihood of leakage past the valve 51 into the intermediate chamber, wherein the pressure could be expected correspondingly to rise to a value greater than that in the inlet chamber 23, so that there might be leakage into the inlet also. This event is to be precluded under any circumstances. Consequently, the valve is supplemented from that as so far described.

Particularly as shown in FIGS. 4 and 5, one principal portion 11 of the valve body is augmented by an abutting portion 61 of the other principal portion 12 thereof. This abutting portion 61 is fabricated of a similar material and is removably assembled with the portion 11 by means of a pair of bolts 62 (FIGS. 3 and 5).

At the junction of the body portions 11 and 61 (FIGS. 4 and 5), there is provided a vent valve seat 63 surrounding an extension 64 of the intermediate chamber, whereas on the other side of the valve seat 63 there is formed in the abutting portion 61 a vent chamber 67 having a vent opening 68 leading to the atmosphere and preferably on the lower side of the vent chamber.

Adapted to seat on the vent valve seat 63 is a poppet vent valve 69 of a construction substantially the same as that of the inlet valve and the outlet valve, but in this instance having an enlarged, cylindrical stem 71 bearing an O-ring 72. The valve stem 71 is designed to reciprocate in a guide 73 projecting from the body portion 61 along the axis 74 of the vent valve. When the valve 69 is closed, there is no flow between the intermediate chamber 31 through the extension 64 into the vent chamber 67 and so through the vent opening 68 to the atmosphere. When the valve 69 is open, then there is easy flow from the intermediate chamber 31 through the next chamber 67 and the opening 68 directly to the atmosphere. The pressure then in the intermediate chamber 31 is substantially atmospheric or slightly thereabove, so that there is no likelihood of any flow from the interior of the body 11 into the inlet line 6, and contamination is therefore completely prevented.

In order to actuate and control the vent valve 69, there is provided a diaphragm 76 of generally planar configuration lying against one face of the body portion 61 and overlain by a diaphragm cap 77 held in position by a number of fasteners 78. The diaphragm is thus well confined and defines an outer diaphragm chamber 79 and an inner diaphragm chamber 81. The stem 71 carries a cap plate 82 secured in position by a fastening screw 83. There is a spring 84 in the inner diaphragm chamber 81 resting against the body portion 61 and against the cap plate 82.

As part of the diaphragm containing structure, including the body portion 61 and the cap 77 there is afforded a first passage 86 extending from the inlet chamber 23 through a sleeve connection 87 surrounded by an O-ring 88 and extending through an aperture 89 in the diaphragm itself. The passage 86 goes an extension passage 90 in the diaphragm cap 77, so that free communication is established between the inlet chamber 23 and the outer diaphragm chamber 79.

In a somewhat similar fashion, there is a second passage 91 partly in the body portion 11 and extending from the intermediate chamber 31 and through a sleeve 92 and O-ring seal 93 and through the rest of the passage 91 in the body portion 12 into the inner diaphragm chamber 81.

With this arrangement, the pressure in the inlet chamber 23 is imposed on the outer side of the diaphragm 76, whereas the pressure in the intermediate chamber 31 is imposed on the under or inner side of the diaphragm 76. This differential pressure, taken into account with the pressure due to the spring 84, either maintains the diaphragm in its position substantially as shown in FIGS. 4 and 5 with the vent valve 69 closed, or under adverse circumstances the pressure inside the intermediate chamber 31, being relatively large, moves the diaphragm away from its position as shown and toward the diaphragm cap 77. This opens the vent valve 69 so that high pressure fluid can discharge from the intermediate chamber 31 through the vent chamber and vent opening 68 to the atmosphere. There is an access plug 94 so that test fixtures or gauges or cocks can be connected into the outer diaphragm chamber 79.

With this arrangement, whenever there is a tendency to backflow due to a higher pressure in the outlet line 7 than there is upstream therefrom toward the inlet line 6, and even though the outlet valve 51 may have become defective and may leak and permit the extra or higher pressure into the intermediate chamber 31, nevertheless the presence of such excessive pressure within the chamber 31 is immediately communicated to the inner side of the diaphragm 76 and augments the pressure thereon due to the spring 84. If, then, the pressure on the other, outer side of the diaphragm in the outer chamber 79 and communicated thereto through the first passage 86 is still relatively low, then the differential pressure opens the vent valve 69 and permits all of the fluid downstream from the inlet valve 34 to discharge to the atmosphere through the vent opening 68, and there is no possibility of back or contaminating flow to the inlet pipe 6. When the differential pressure drops to a normal valve, the parts return to their normal, illustrated positions.

With this arrangement, and since the valve is expected to serve for many years, it is quite possible at any time simply by removing the various bolts, such as 19, and very slightly spreading the pipes 6 and 7 to withdraw the backflow preventing valve laterally for bench tests or the like. Equally simply, a properly conditioned valve can be reintroduced into the line and again bolted in position for further service. Also, because of the various plugs, the valve can be checked at any time by appropriate test techniques to make sure that it is in full and effective service operation.

Since the body of the valve is comprised of nonmetallic materials, there is no transmission of electrical voltages across or through the valve, so that some of the possible bad effects of electrolysis are greatly reduced. Furthermore, since the valve is of a plastic material that partakes of a very smooth surface finish, the pressure drop through the valve is somewhat less than is customary. Also, since the main body of the valve is made in two principal portions, the entire interior of the valve is subjected to ready access and complete and thorough visual inspection at all times. There has therefore been provided a relatively simple, economical and superior backflow preventing valve.

I claim:

1. A backflow preventing valve comprising a first body portion terminating in a predetermined planar face, said first body portion having an inlet port and an outlet port both in alignment on a through first axis extending in a plane parallel to said planar face, means defining an inlet chamber in said first body portion open to said inlet port and also extending along a second axis disposed in said plane and intersecting said first axis, means defining an outlet chamber in said first body portion open to said outlet port and also extending along a third axis disposed in said plane and intersecting said second axis, means defining an intermediate chamber in said first body portion merging with said inlet chamber at an inlet valve seat centered in said plane and also merging with said outlet chamber at an outlet valve seat in said plane, an inlet valve in said intermediate chamber and having a valve stem movable in said plane toward and away from said inlet valve seat, a first spring in said intermediate chamber urging said inlet valve toward said inlet valve seat, an outlet valve in said outlet chamber and having a valve stem movable in said plane toward and away from said outlet valve seat, a second spring in said outlet chamber urging said outlet valve toward said outlet valve seat, a second body portion terminating in a predetermined planar face, means for releasably holding said first body portion and said second body portion with said planar faces substantially coincident and parallel to said plane, means defining in said first body portion an extension of said intermediate chamber disposed substantially perpendicular to said plane, means in said first body portion defining a vent valve seat surrounding said extension and substantially parallel to said plane, means defining in said second body portion a vent chamber extending perpendicular to said first plane and merging with said extension, means defining a vent to the atmosphere from said vent chamber, a vent valve having a stem movable in said extension normal to said plane and having on said stem a head movable into and out of engagement with said vent valve seat, a planar cap plate on said vent valve stem and extending parallel to said plane, a spring interposed between said second body portion and said cap plate for urging said vent valve away from said vent valve seat, a planar diaphragm extending parallel to said plane and abutting said cap plate and said second body portion, a diaphragm cap overlying said planar diaphragm on the side thereof opposite said cap plate and thereby establishing a diaphragm chamber, means for securing said diaphragm cap through said planar diaphragm to said second body portion, and means for establishing an air passage substantially normal to said first plane and extending from said inlet chamber then through said first body portion and then through said second body portion and then through said diaphragm and said cap into said diaphragm chamber.

* * * * *